US005848911A

United States Patent [19]

Garcin

[11] Patent Number: 5,848,911

[45] **Date of Patent: *Dec. 15, 1998**

[54] INSULATION-STRIPPING ELECTRICAL CONTACT DEVICE

[75] Inventor: Michel Garcin, Pontarlier, France

[73] Assignee: Framatome Connectors International, Courbevoie, France

[ * ] Notice: This patent issued on a continued prosecution application filed under 37 CFR 1.53(d), and is subject to the twenty year patent term provisions of 35 U.S.C. 154(a)(2).

[21] Appl. No.: 649,970

[22] Filed: May 15, 1996

[30] Foreign Application Priority Data

May 16, 1995 [FR] France ..... 95 05755

[51] Int. Cl.[6] ..... H01R 4/24

[52] U.S. Cl. ..... 439/395

[58] Field of Search ..... 439/395, 397, 439/404, 405, 942

[56] References Cited

U.S. PATENT DOCUMENTS

| | | | |
|---|---|---|---|
| 3,798,587 | 3/1974 | Ellis, Jr. et al. | 439/403 |
| 3,854,114 | 12/1974 | Kloth et al. | 439/395 |
| 3,858,159 | 12/1974 | Worth | 439/405 |
| 4,023,883 | 5/1977 | Raposa et al. | 439/404 |
| 4,208,083 | 6/1980 | Kirby | 439/395 |
| 4,547,034 | 10/1985 | Forberg et al. | 439/404 |
| 4,611,874 | 9/1986 | Gerke et al. | 439/404 |
| 4,615,576 | 10/1986 | Gerke et al. | 439/404 |
| 4,691,977 | 9/1987 | Marzili et al. | 439/404 |
| 4,731,003 | 3/1988 | Bajohr et al. | 439/395 |
| 4,894,021 | 1/1990 | Holden et al. | 439/395 |
| 4,964,812 | 10/1990 | Siemon et al. | 439/403 |
| 5,044,979 | 9/1991 | Siemon et al. | 439/404 |
| 5,120,235 | 6/1992 | Kashiwa | 439/405 |
| 5,522,733 | 6/1996 | White et al. | 439/395 |

FOREIGN PATENT DOCUMENTS

| | | |
|---|---|---|
| 0 643 440 A2 | 3/1995 | European Pat. Off. . |
| 0 643 441 A2 | 3/1995 | European Pat. Off. . |
| WO 92/08255 | 5/1992 | WIPO . |
| WO 92/22941 | 12/1992 | WIPO . |

*Primary Examiner*—Gary F. Paumen
*Assistant Examiner*—Tho D. Ta
*Attorney, Agent, or Firm*—Perman & Green, LLP

[57] ABSTRACT

The invention concerns an insulation-stripping electrical contact device (1). Contact (1) according to the invention comprises two asymmetrical blades (10, 11), one being wider than the other. These two blades (10, 11) are positioned in two grooves (200, 201) produced in the walls of slots (21) for introduction of cable (3). The wider blade (10) is positioned in a groove (201) forming an angle with the introduction direction (Δ') of cable (3) and the narrower blade (11) is positioned in a groove (200) forming an angle of 90° with this same direction (Δ'). For cables (3) of small section, only the wider blade (10) is bent and pressed; for cables (3) of greater section, the narrower blade (11) is pushed into its housing (200). In both cases, a wedging effect and a displacement of the cut points are produced.

15 Claims, 3 Drawing Sheets

INSULATION-STRIPPING ELECTRICAL CONTACT DEVICE

FIELD OF THE INVENTION

The invention concerns an insulation-stripping electrical contact device.

BACKGROUND OF THE INVENTION

In the prior art, numerous insulation-stripping electrical contact elements of this type have been proposed. These insulation-stripping contact elements are supported by the insulation part of a terminal or a similar component, which is provided with an introduction opening or slot. The electrical contact itself has one or more blades that cut the insulation of an electrical wire or cable when it is introduced into the opening or slot and the contact penetrates into the conductive core of the cable. As a result, a conductive contact is established between the conductive core and the insulation-stripping contact. The contact is generally extended by a gripping component for electrical contact (coupling component or pin) on which can be inserted a complementary component forming the end of an electrical cable, or, in another design, the coupling pin can be inserted into a metallized opening of a printed circuit board.

In a classical configuration, insulation-stripping contacts comprise a "lyre" a "V" shape, whose elastic arms play the role of blades with the cutting edge turned toward the inside. These blades are parallel and found in the same plane. They are separated by a slot whose size is adapted to the dimensions of the wires or cables that will be introduced into the self-stripping contacts. The introduction of a cable between the two blades triggers the stripping process. Due to their elasticity, the blades cut the insulating sheath while assuring the retention of the cable.

In patent application PCT WO-A-92/22941 (MOD-TAP W. CORPORATION), an improved insulation-stripping contact was proposed, whose blades work by twisting.

In order to obtain this effect, two special features are used:

- the blades have an angular displacement relative to the axis for introduction of the cable into the slot;
- the blades are supported on the extreme walls of the insulator by means of protuberances situated on the upper part of the blades.

The blades are then held by clamping their upper part. When one or more cables are introduced into the slot, a circular-arc deformation results, which guarantees a good operation of the device.

Although it certainly has advantages over the prior known techniques, this device does not permit fulfilling all the requirements experienced in the field; in particular, it cannot guarantee a constant efficacy for cables of different diameters.

SUMMARY OF THE INVENTION

While conserving the advantages of devices of the prior art, notably an elastic operation of the "V"-shaped blades, the invention proposes an insulation-stripping electrical contact device in which its operation may differ, depending on the physical characteristics of the introduced cable, and especially its diameter.

To do this, the invention proposes using an insulation-stripping electrical contact comprising two blades of distinct sections, forming a specific angle between them. The blade with the smaller section is positioned in a plane orthogonal to the axis of the cable introduction and the blade with the larger section is positioned in a plane forming an angle equal to the angle defined by this same axis. As a result, and due to the complementary arrangements which will be detailed below, it is possible to obtain the previously-mentioned differentiated operation.

The subject invention therefore is a device comprising at least one insulation-stripping electrical contact element positioned in a slot made in an insulating unit and designed to receive a cable furnished with an insulating covering, along an insertion axis, said insulation-stripping contact element comprising a first and a second blade, joined by a common base and separated by a slot of a given width into which is inserted said cable, characterized in that the two blades have different widths, in that said slot made in the insulating unit comprises first and second grooves on the lateral walls facing one another, in that the first groove extends along an axis orthogonal to said insertion axis, in that the second groove extends along an axis forming a specific angle with said insertion axis greater than zero and less than 90°, in that the blade of the smaller width or first blade is inserted into the first groove and the wider blade or second blade is inserted into the second groove so that they form between them an angle equal to said given angle, and in that the second blade is bent and pressed toward one of the lateral walls of the second groove when a cable is inserted between the two blades, and in that the cutting edges of said first and second blades cooperate to exert a wedging effect on said cable and displace the cut points of said insulating covering, so as to carry out said insulation stripping.

BRIEF DESCRIPTION OF THE DRAWINGS

The invention will be better understood and other characteristics and advantages will appear upon reading the description that follows in reference to the attached figures, in which:

FIG. 5 shows the introduction of a cable of a first diameter and FIG. 6 shows the introduction of a cable with a second diameter which is greater than the first.

DETAILED DESCRIPTION OF THE INVENTION

According to an essential characteristic of the invention, the insulation-stripping contact element comprises two asymmetrical blades.

Figure 1:
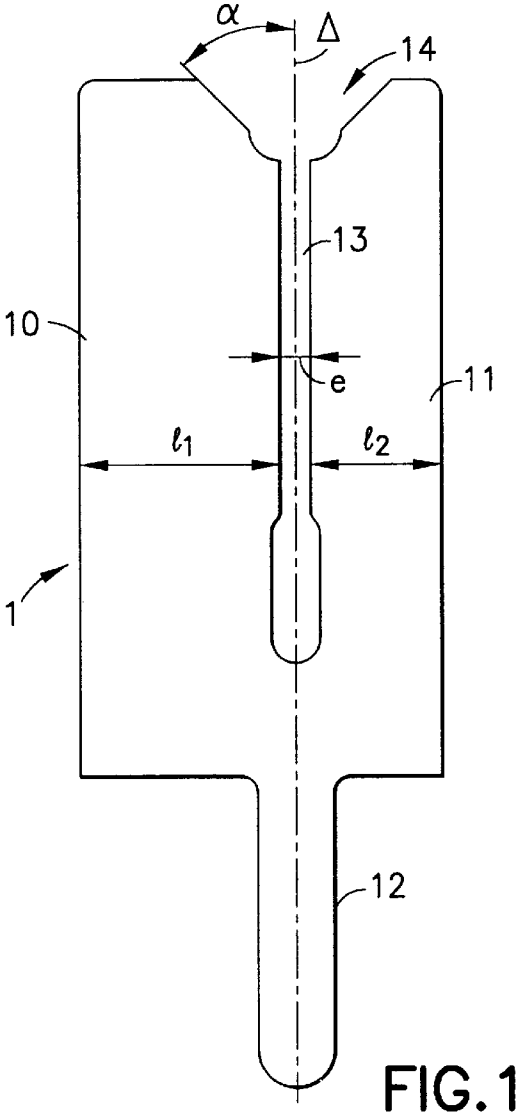
FIG. 1 shows an example of a section of an insulation-stripping electrical contact element according to the invention.

FIG. 1 illustrates an example of such an insulation-stripping contact element 1. It comprises an elongated principal part, comprised of two pieces 10 and 11, extending parallel to a vertical axis (in FIG. 1) Δ. The two pieces 10 and 11, joined by a common base, are separated by a thin longitudinal slot 13, of width "e". This width "e" is determined as a function of the precise application envisioned, notably the diameter of the cables to be inserted here. In the upper part, the two pieces 10 and 11 are flared so as to form a "V" whose arms form an angle α with axis A mentioned above. This arrangement, known in and of itself, permits an easier guiding of a cable (not shown), for purposes of its insertion into slot 13.

As illustrated by FIG. 1, piece 10 has a width $1_1$ greater than the width $1_2$ of piece 11.

Advantageously, the main part of the insulation-stripping contact element 1 can be extended towards the bottom by a tab 12 aligned (in the example described) along vertical axis Δ. This tab 12 serves for making electrical contact with another component, for example a cable (not shown) provided, at its end, with a contact element of a complementary form, or this tab can be inserted into a metallized opening of a printed circuit board.

The production of such an insulation-stripping contact element 1 is known in and of itself. It can be obtained, for example, by stamping a metal strip with appropriate physical characteristics: thickness, elasticity, etc.

Figure 2:
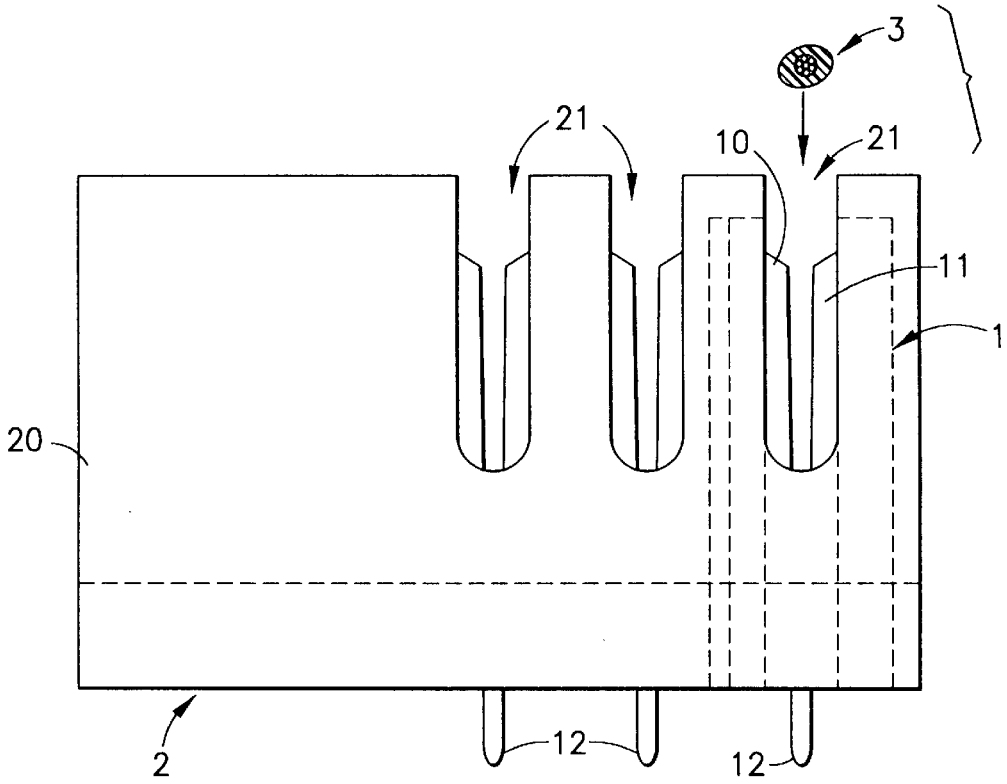
FIGS. 2 and 3 illustrate the side and top views of a terminal comprising such contact elements.
Figure 3:
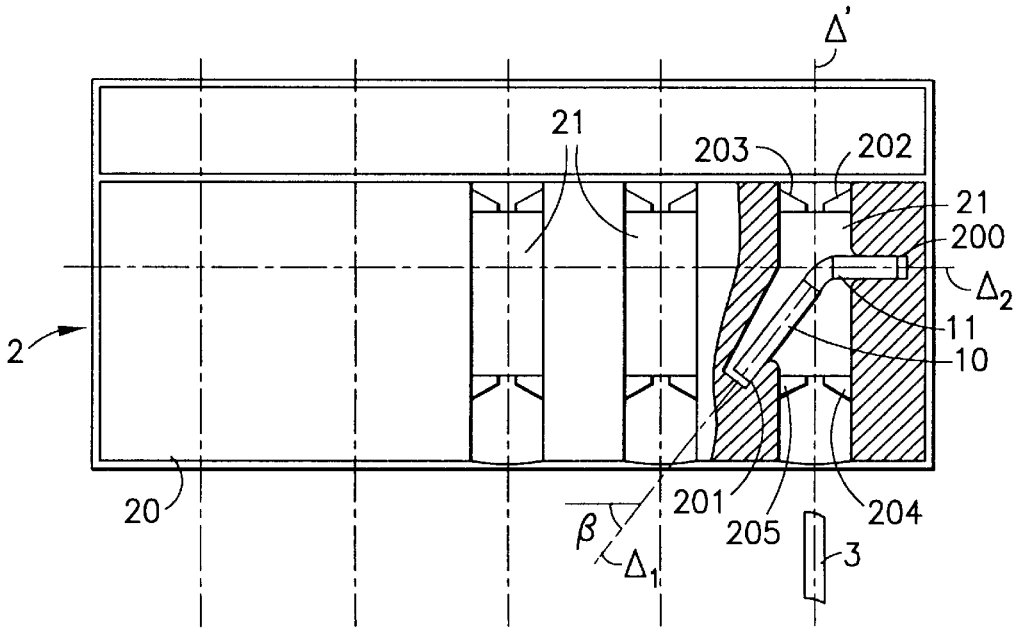

As illustrated by FIGS. 2 and 3, these insulation-stripping contact elements are mounted in slots 21 provided for this purpose, of a terminal 2.

More precisely, FIG. 2 illustrates an example of terminal 2, viewed from the side, and FIG. 3, this same terminal 2, viewed from the top. In this example, vertical cuts are made (in FIG. 2) in main part 20 of terminal 2 to better show the positionings particular to the invention.

In fact, according to a second important characteristic of the invention, insulation-stripping contact element 1, which is flat during its production (see FIG. 1), is inserted into the cable insertion slots 21 so that the planes of pieces 10 and 11 form between them an angle β, as illustrated more particularly by FIG. 3. This angle is comprised in the range of $0<\beta<90°$. Typically, β is about 40°.

Figure 4:
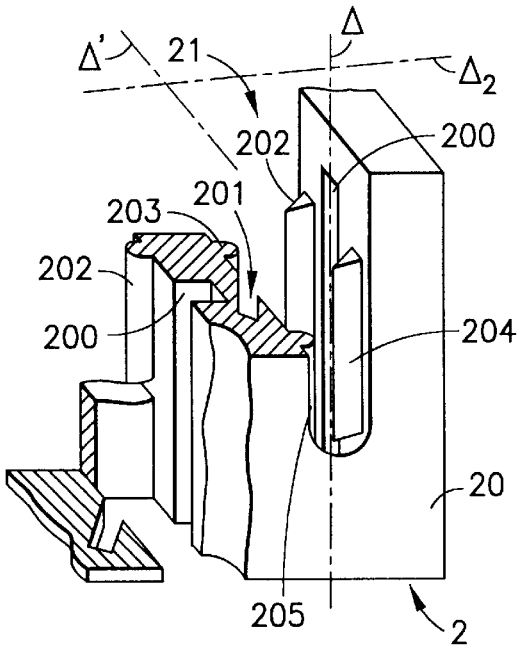
FIG. 4 shows a detailed, peeled-away view, of such a terminal.

To do this, the [supporting] main part 20 of insulation-stripping contact element 1 is provided, in slots 21, with recessed grooves 200 and 201, of sufficient height so that pieces 10 and 11 can be inserted therein. Moreover, as illustrated more particularly by detailed FIG. 4, which represents two adjacent slots 21 in peeled-away view, groove 200 extends parallel to an axis $\Delta_2$ orthogonal to an axis Δ', parallel to the average insertion direction of cables 3 into slots 21. Groove 201 extends parallel to an axis $\Delta_1$ forming an angle β with axis Δ'. Then pieces 10 and 11 form the same angle β between them.

A certain lateral play is maintained for piece 10 in its housing (groove 200). It is sufficient, as is shown more particularly in FIG. 3, that the walls of groove 200 are not parallel to each other, in other words, they may have a slight divergence so that groove 201 is flared in the shape of a funnel.

Finally, piece 11 is not completely inserted into groove 200 so that its outer edge (right edge in FIGS. 3 and 4) does not touch the bottom of this groove.

Insulation-stripping contact element 1 is thus cambered and then inserted forcefully into slot 21 and curved as a result of the geometric characteristics of grooves 200 and 201.

Moreover, through grooves 200 and 201, and along axis Δ', two pairs of vertical abutments facing one another are provided, two abutments on the right wall, 202 and 204, and two on the left wall, 203 and 205. These abutments will serve for guiding and holding cable 3 which is introduced into slot 21, for purposes of the local stripping of covering 31 and the creation of a conductive contact between core 30 and insulation-stripping contact element 1.

Figure 6:
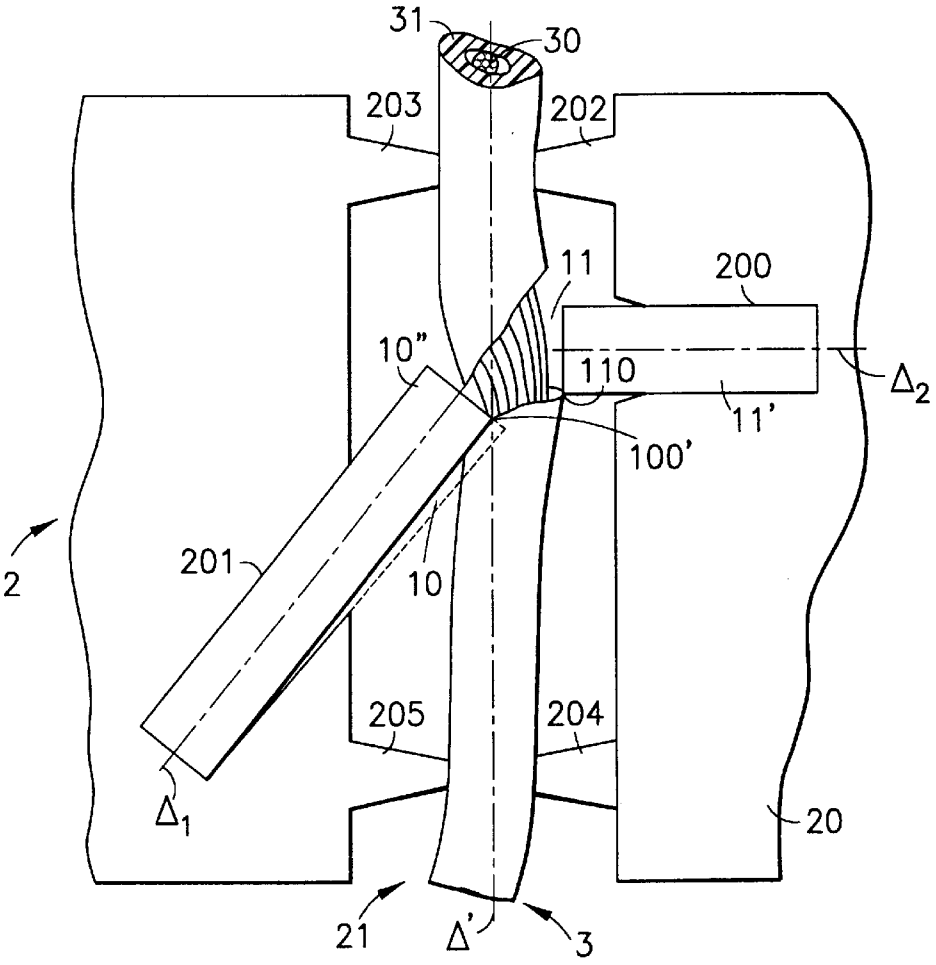
FIGS. 5 and 6 illustrate the operation of the terminal with insulation-stripping electrical contact elements.
Figure 5:
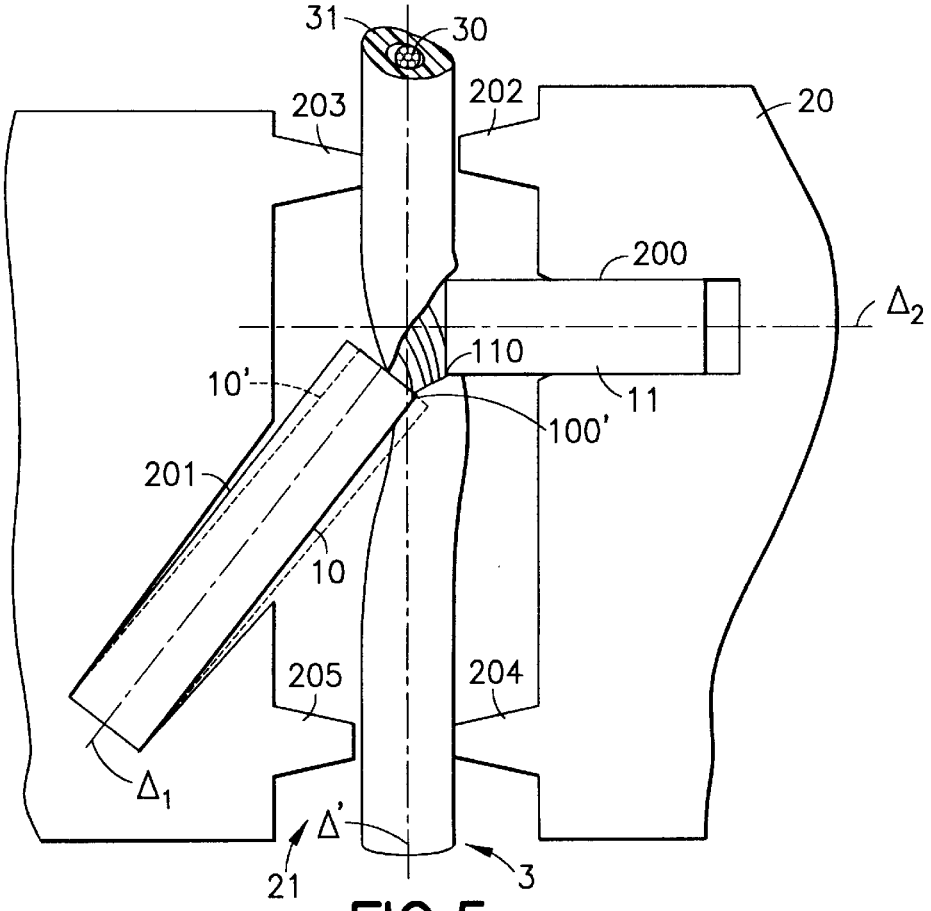

We will now consider two cases illustrated by FIGS. 5 and 6, respectively.

The first case concerns a cable of outer diameter that we will qualify as "small". This concept is relative, of course. A correlation must be effected between the diameter or section of cable 3 and the dimensions of insulation-stripping contact element 1, in particular the distance "e" (FIG. 1) between pieces 10 and 11.

To illustrate this concept, we will suppose that "e" is equal to 0.4 mm (pieces 10 and 11 are in the same plane, i.e., during the manufacture of an insulation-stripping contact element 1) and that the thickness of the metal sheet from which contact element 1 is made is equal to 0.5. If we suppose, moreover, that angle β is roughly equal to 40°, the residual distance "e" (see FIG. 1) between the facing cutting edges of the two pieces 10 and 11, forming blades, is reduced to approximately 0.15 mm.

For the values above, it can be considered that a cable of a diameter of the order of 0.4 mm is a cable of "small" section and therefore conforms to the first case that we will detail below.

FIG. 5 illustrates the functioning of an insulation-stripping contact element 1 for this first case.

Cable 3 is introduced into slot 21 and, more precisely, between the two blades 10 and 11. As a result of the flared shape of the upper end of these blades (FIG. 1:), a guiding effect and a precise positioning of cable 3 is obtained, making it easier to introduce it into the gap between blades 10 and 11. If a force is directed toward the bottom, the forceful insertion process between the two blades is initiated. Cable 3 is held roughly rectilinear, aligned on axis Δ', as a result of the presence of the pairs of vertical abutments, 202–203 and 204–205, respectively.

The wider blade 10 is bent and pressed toward the left wall (in FIG. 5) of groove 201: position 10'. It may end up abutting said left wall. Simultaneously, cutting edge 100' of this blade cuts insulating covering 31 and a conductive contact is established with core 30 of cable 3.

As has been indicated, since the section of cable 3 is assumed to be "small", the position of the narrower piece 11, whose plane is orthogonal to the average insertion axis Δ' of cable 3, undergoes little or no change. The right edge (in FIG. 5) remains far from the bottom of groove 200. However, cutting edge 110 also cuts insulating covering 31 of cable 3 and comes into conductive contact with core 30 of cable 3. Blade 11 therefore acts as a "fixed beam" in this case.

The cooperation of the two blades has for an effect the result that the second blade, i.e., blade 11, exerts a wedging effect on cable 3 and the cut points of insulation covering 31 are displaced along axis Δ'. This arrangement permits moving aside the cut insulation sections. Good local stripping of cable 3 occurs over a thickness roughly equal to that of insulation-stripping contact element 1.

The shifted position of the cutting blades along the axis of the wire causes a displacement of the cuts made in the latter, which promotes the tearing resistance of the remaining copper section. There is then less risk of breaking of the wire.

The second case considered relates to cables 3 of a section referred to as "large", i.e., typically comprised within a range of 0.4 mm to 0.8 mm, still applying the previously-mentioned dimensions for insulation-stripping contact element 1.

This case is illustrated by FIG. 6. The operating mode is strictly the same as that described with regard to FIG. 5, so that it is unnecessary to describe this in detail again. As before, the second blade, i.e., blade 10 is bent and pressed in groove 201 (position 10") up to the left wall, taking into account the wider section of cable 3. Moreover, the first blade, i.e., blade 11, is pulled by translation and is also forced into its "housing", i.e., into groove 200, along axis $\Delta_1$. Depending on the sectional thickness of cable 3, it will be forced more or less deeply into this groove 200 until it abuts the bottom of the latter: position 11", as shown in FIG. 6.

As previously noted, the cooperation of the two blades has caused the second blade, i.e., blade 11 (position 11") to exert a wedging effect on cable 3 and the cut points of insulation covering 31 are displaced along axis Δ'. This arrangement permits separating the cut insulation sections. There is a good local stripping of cable 3 over a thickness roughly equal to that of insulation-stripping contact element 1.

In summary, there is always a wedging effect. Moreover, the asymmetric positioning of the blades has an additional advantage: it permits a reduction of the spacing between contacts, while keeping a sufficient blade width.

Upon reading the above description, it is observed that the invention clearly achieves the objectives established for it. It permits an equal operating efficacy for cables of different diameters, more precisely for cables of diameters comprised within two ranges, called "small" and "large", relative to the dimensions of the insulation-stripping contact element 1 itself.

Nevertheless, it should be clear that the invention is not limited solely to the examples of embodiment previously described, notably in relation to FIGS. 1 to 6. In particular, the numerical data have not been specified in detail so as to better illustrate the invention and, in any case, not to limit its scope.

It should also be clear that the number of contact elements per terminal or similar component is only limited by practical considerations, this number being at least equal to one. The number of contacts depends on the precise application for which the terminal is used.

Finally, the number of rows of insulation-stripping contact elements is also not limited to one. For example, a terminal can be designed (not shown) with two parallel rows of insulation-stripping contact elements, positioned in slots that may or may not be offset.

I claim:

1. A device comprising:

an insulating housing (20) having a receiving area with a contact receiving slot (21) extending across the receiving area, the receiving area being designed to receive a cable (3) with insulating covering (31) thereon, the cable being inserted into the receiving area along an insertion axis (Δ'); and an insulation stripping contact (1) positioned in the contact receiving slot (21), the contact having a first blade (11) and a second blade (10) joined to a common base to form a cable receiving slot (13) of a given width ("e") between the first and second blades, and the contact (1) being located in the contact receiving slot (21) of the insulating housing (20) such that, when the cable (3) is received in the receiving area of the housing, the cable (3) is inserted into the cable receiving slot (13) of the contact;

wherein the contact receiving slot (21) comprises a first groove (200) and a second groove (201) formed in the opposing side walls of the receiving area of the housing, the first groove (200) being angled relative to the second groove (201) with the first groove (200) being orientated relative to the insertion axis (Δ') at an angle of about 90° and the second groove (201) forming an angle (β) with the insertion axis (Δ') greater than 0° and less than 90°, and wherein the first blade (11) has a smaller width than the second blade (10) and the first blade (11) is located in the first groove (200) and the second blade (10) is located in the second groove (201) of the contact receiving slot (13) so that the first blade is angled relative to the second blade, the first groove being adapted to allow the first blade to translate therein without substantial rotation, the first blade butting a bottom of the first groove when the first blade is subjected to a force directed along an axis orthogonal to the axis of insertion (Δ'), and wherein when the cable is inserted in the cable receiving slot the second blade is bent and pressed toward a first side wall of the second slot and the first and second blades cooperate to cut and wedge apart the insulation covering of the cable.

2. A device according to claim 1, further characterized in that said receiving area (21) produced in said insulating part (20) comprises two pairs of abutments (202–203, 204–205) positioned astride both said first groove (200) and second groove (201), one of the abutments from each pair of abutments being located on each of the opposing lateral walls of the receiving area.

3. A device according to claim 1, further characterized in that said second groove (201) has a flared funnel shape so as to permit flexing second blade (10).

4. A device according to claim 1, further characterized in that when a cable (3) of a section roughly equal to the given width ("e") of said cable receiving slot (13) is inserted between said first blade and second blade, only said second blade (10) is bent and pressed toward the first side wall of said second groove (201), said first blade (11) remaining fixed, and in that when a cable (3) of section greater than given width ("e") of said cable receiving slot (13) is inserted between said first blade and second blade said second blade (10) is bent and pressed to abut on the first side wall of said second groove (201) and said first blade (11) is pulled by translation (11') toward the bottom of said first groove (200).

5. A device according to claim 1, further characterized in that the slot between said first blade and second blade has a flared opening (14) so as to facilitate the insertion of said cable (3) into said longitudinal slot (13).

6. A device according to claim 1, further characterized in that said given angle (β) is roughly equal to 40°.

7. A device according to claim 1, further comprising several of the insulation-stripping contacts (1) arranged in corresponding grooves (21) produced in said insulating housing (20) and aligned on an axis (Δ) orthogonal to said insertion axis (Δ').

8. A device according to claim 7, further characterized in that each of said insulation-stripping contacts (1) is extended, at the base, by a tab for making electrical contact (12), and in that this tab (12) extends from said insulating part (20) in a zone opposite said slot (21).

9. A device according to claim 1, wherein the first groove has opposing sides located to form a close fit with the first blade held therein so that when the cable is inserted into the receiving area and between the first blade and second blade the first blade will axially translate freely within the first groove but will not rotatably twist within the first groove.

10. A device according to claim 9, wherein the first blade has an end face and the first groove has a stop surface, and wherein a gap is formed between the end face and the stop surface when the first blade is inserted into the first groove, the gap being closed by translation of the first blade when the cable is inserted into the receiving area and between the first blade and second blade.

11. A device according to claim 10, wherein the opposing sides of the first groove are aligned substantially orthogonal to a longitudinal axis of the receiving area, and wherein a first one of the opposing sides is longitudinally located in the receiving area proximate a corresponding one of the cutting edges corresponding to the second blade when the second blade is inserted in the second groove.

12. A device according to claim 11, wherein the second blade is located in the second groove with an end face of the second blade abutting a stop surface of the second groove so that when the cable is inserted in the receiving area and between the first blade and the second blade, the second blade will not translate axially.

13. An electrical connector comprising:

a housing having a conductor receiving channel to receive a conductor with an insulation cover, the conductor receiving channel having a first groove and a second groove located on an opposite sides of the conductor receiving channel;

an insulation stripping electrical contact located within the housing, the contact having a first blade and a second blade connected by a span section, the first blade being located in the first groove so that the first blade is rotatably twistable within the first groove, and the second blade being held in the second groove so that the second blade is only axially translatable and cannot rotatably twist within the second groove;

wherein, when the conductor is inserted between the first blade and second blade in the conductor receiving channel the first blade rotatably twists to contact a restraining wall of the first groove and the second blade solely axially translates in a direction substantially perpendicular to the conductor receiving channel so that the first blade and second blade maintain a substantially constant cutting pressure on the conductor for varying thicknesses of the conductor, the cutting pressure being applied by the first blade and the second blade being sufficient to cut the insulation cover and electrically contact the conductor.

14. An electrical connector, comprising;

a housing with a conductor receiving area to receive a conductor with an insulation cover, the conductor receiving area having a pair of grooves formed into opposing lateral sides of the conductor receiving area; and an insulation stripping contact comprising a pair of resiliently flexible blades to cut the insulation cover and make electrical contact with the conductor, a first one of the blades being located in a first one of the pair of grooves and a second one of the blades being located in a second one of the pair of grooves;

wherein, the first one of the pair of grooves extends along an axis forming an angle with the conductor receiving area greater than 0° and less than 90° and the second one of the grooves is aligned substantially perpendicular to a first one of the opposing lateral sides of the conductor receiving area.

15. An electrical connector as in claim 14, wherein the second one of the blades is substantially perpendicular to the first one of the opposing lateral sides of the receiving area when the second one of the blades is located in the second one of the grooves, and the first one of the blades is angled relative to the second one of the blades.

* * * * *